US008269805B2

(12) United States Patent
Huang et al.

(10) Patent No.: US 8,269,805 B2
(45) Date of Patent: Sep. 18, 2012

(54) IMAGE PROCESSING MODULE WITH LESS LINE BUFFERS

(75) Inventors: Chung-Hsun Huang, Hsinhua (TW); Kuei-Hsiang Chen, Hsinhua (TW)

(73) Assignee: Himax Technologies Limited (TW)

( * ) Notice: Subject to any disclaimer, the term of this patent is extended or adjusted under 35 U.S.C. 154(b) by 920 days.

(21) Appl. No.: 11/296,690

(22) Filed: Dec. 8, 2005

(65) Prior Publication Data

US 2006/0146076 A1 Jul. 6, 2006

(30) Foreign Application Priority Data

Dec. 8, 2004 (TW) ..... 93138037 A

(51) Int. Cl.
*G09G 5/02* (2006.01)

(52) U.S. Cl. ..... 345/698; 345/99

(58) Field of Classification Search ..... 345/698–699, 345/3.3–3.4, 98–99
See application file for complete search history.

(56) References Cited

U.S. PATENT DOCUMENTS

| | | | | |
|---|---|---|---|---|
| 6,040,826 | A * | 3/2000 | Furukawa | 345/534 |
| 6,304,297 | B1 * | 10/2001 | Swan | 348/556 |
| 6,628,260 | B2 * | 9/2003 | Furuhashi et al. | 345/98 |
| 7,215,376 | B2 * | 5/2007 | Adams et al. | 348/452 |
| 2004/0027363 | A1 * | 2/2004 | Allen | 345/698 |
| 2004/0046773 | A1 * | 3/2004 | Inoue et al. | 345/698 |
| 2005/0008230 | A1 * | 1/2005 | Sasaki | 382/232 |
| 2005/0093797 | A1 * | 5/2005 | Sung et al. | 345/89 |

* cited by examiner

*Primary Examiner* — Chanh Nguyen
*Assistant Examiner* — Long D Pham
(74) *Attorney, Agent, or Firm* — McDermott Will & Emery LLP

(57) ABSTRACT

An image processing module with less line buffers is provided. The image processing module receives an original image signal to drive a display panel. The image processing module includes a timing controller and a scaler. The timing controller includes a line buffer and a control unit. The line buffer registers the original image signal and outputs a storage image signal. The scaler receives the storage image signal, adjusts the resolution of the storage image signal, and outputs a scaled image signal to the control unit according to the resolution of the storage image signal. The control unit receives the scaled image signal and outputs a display signal to drive the display panel according to the scaled image signal.

15 Claims, 11 Drawing Sheets

IMAGE PROCESSING MODULE WITH LESS LINE BUFFERS

This application claims the benefit of Taiwan application Serial No. 93138037, filed Dec. 8, 2004, the subject matter of which is incorporated herein by reference.

BACKGROUND OF THE INVENTION

1. Field of the Invention

The invention relates in general to an image processing module, and more particularly to an image processing module with less line buffers.

2. Description of the Related Art

If resolution of the image signal is different from the resolution of the display, the resolution must be adjusted in the course of image processing. That is, a scaler is used to adjust the image signal with different resolution to the resolution of the display. Referring to FIG. 1, a block diagram of a conventional image processing system is shown. Image processing system 100 includes a scaler 110 and a timing controller 120. The scaler 110 receives and registers the original image signal Si in the line buffer 111, the original image signal Si is scaled and the resolution of the original image signal Si is adjusted, and then an image signal S1 is outputted. The timing controller 120 receives the image signal S1 and outputs a display signal S2 according to the image signal S1 to drive the display panel 130.

As the resolution of video image increases, data volume and transmission speed also increase. However, a few problems, such as electromagnetic interfering, (EMI) for instance, also arise at the same time. Therefore, another image processing system structure in response to high resolution image processing is provided. Referring to FIG. 2, a block diagram of a conventional image processing system capable of processing high resolution image is shown. Image processing system 200 includes a scaler 110 and a timing controller 220. The scaler 110 includes a line buffer 111. The scaler 110 receives and registers the original image signal Si in the line buffer 111, the original image signal Si is scaled and the resolution of the original image signal Si is adjusted, and then an image signal S1 is outputted. The timing controller 220 includes a line buffer 221. The timing controller 220 receives and registers the image signal S1 in the line buffer 221, the timing in the data of the image signal S1 is changed, and then a front-display signal Sf and a back-display signal Sb are outputted to drive the display panel 230.

The main difference between the image processing system of FIG. 2 and that of FIG. 1 lies in the timing of the data of the display signal transmitted to the display panel. In FIG. 1, the timing controller 120 transmits the pixel data of the same horizontal line in the display signal S2 from left to right to the display panel 130. In FIG. 2, the timing controller 220 divides the frame of the display into a front frame and a back frame. That is, each horizontal line is divided into a front-horizontal line and a back-horizontal line. The timing controller 220 transmits the image data of the front-horizontal line and the back-horizontal line to the display panel 230 at the same time. Referring to FIG. 3A, a pixel diagram of the display panel 130 is shown. The display panel 130 has a horizontal line L1. The horizontal line L1 has a pixel 1, pixel 2, pixel 3, and pixel 4 etc. The timing controller 120, following the sequence of the pixel 1, the pixel 2, the pixel 3 and the pixel 4, transmits the corresponding display signals S2 to the display panel 130 sequentially. Referring to FIG. 3B, a diagram of dividing the display panel 230 into a front frame and a back frame is shown. The display panel 230 has a horizontal line L2. The horizontal line L2 is divided into a front-horizontal line L2*f* and a back-horizontal line L2*b*. The front-horizontal line L2*f* includes a pixel f1, a pixel f2 and a pixel f3. The back-horizontal line L2*b* includes a pixel b1, a pixel b2 and a pixel b3. The timing controller 120, following the sequence of the pixel f1, the pixel f2 and the pixel f3, transmits the corresponding front-display signals Sf to the display panel 230 sequentially, while the timing controller 120, following the sequence of the pixel b1, the pixel b2 and the pixel b3, transmits the corresponding back-display signals Sb to the display panel 230 sequentially.

In order to simultaneously output the front-display signal Sf and the back-display signal Sb, the timing controller 220 needs a line buffer 221 in which the data are registered. However, in order to meet the standard of high resolution, both the scaler 210 and the timing controller 220 are equipped with a line buffer, which is redundant and uneconomical.

SUMMARY OF THE INVENTION

It is therefore the object of the invention to provide an image processing module with less line buffers. Unlike the conventional structure, the image processing structure provided in the invention dispenses with repetition of line buffer thus avoiding unnecessary increase in cost.

According to an object of the invention, an image processing module used for receiving an original image signal to drive a display panel is provided. The image processing module includes a timing controller and a scaler. The timing controller includes a line buffer and a control unit. The line buffer registers the original image signal, and then outputs a storage image signal. The scaler receives the storage image signal, adjusts the resolution of the storage image signal, and outputs a scaled image signal to the control unit according to the resolution of the storage image signal. The control unit receives the scaled image signal and outputs a display signal to drive the display panel according to the scaled image signal.

Other objects, features, and advantages of the invention will become apparent from the following detailed description of the preferred but non-limiting embodiments. The following description is made with reference to the accompanying drawings.

DETAILED DESCRIPTION OF THE INVENTION

Embodiment One

Figure 4:
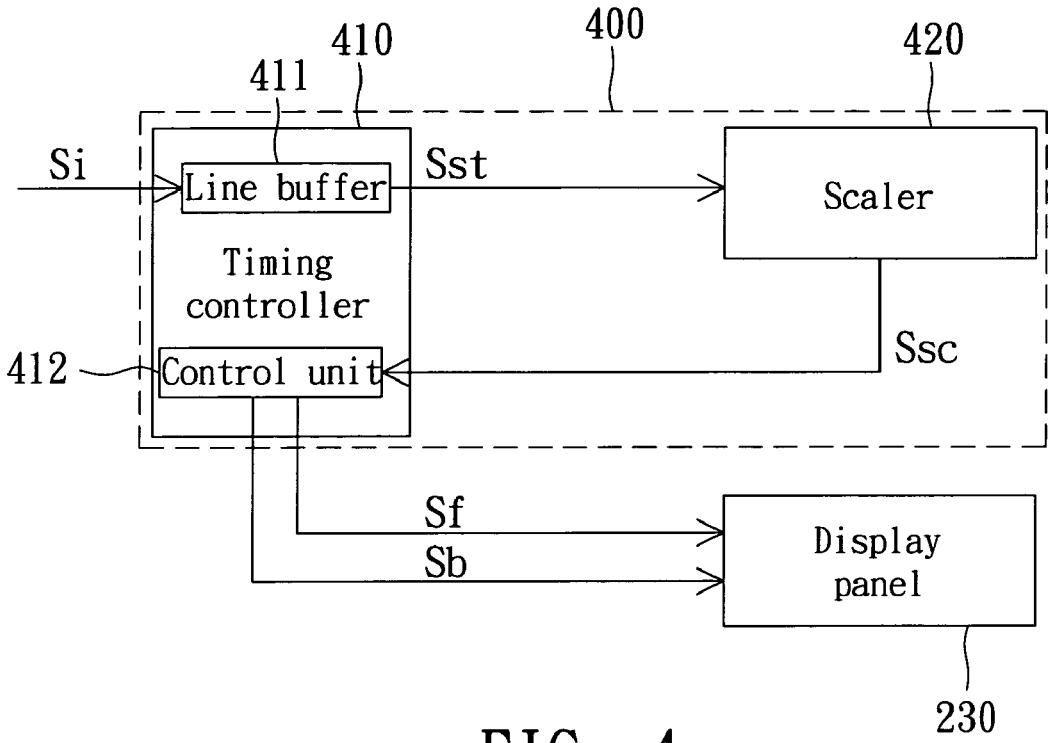
FIG. 4 is a block diagram of an image processing module according to a first embodiment of the invention.

Referring to FIG. 4, a block diagram of an image processing module according to a first embodiment of the invention is shown. Image processing module 400 is used for receiving an original image signal Si to drive the display panel 230. The image processing module 400 includes a timing controller 410 and a scaler 420. The timing controller 410 receives the original image signal Si, then outputs a storage image signal Sst. The scaler 420 receives the storage image signal Sst, adjusts the resolution of the storage image signal Sst, and then outputs a scaled image signal Ssc. Afterwards, the timing controller drives the display panel 230 according to the scaled image signal Ssc. The timing controller 410 includes a line buffer 411 and a control unit 412. The line buffer 411 registers the original image signal Si, and then outputs the storage image signal Sst. The control unit 412 receives the scaled image signal Ssc, and then outputs a front-display signal Sf and a back-display signal Sb to drive the display panel 230 according to the scaled image signal Ssc.

Figure 1:
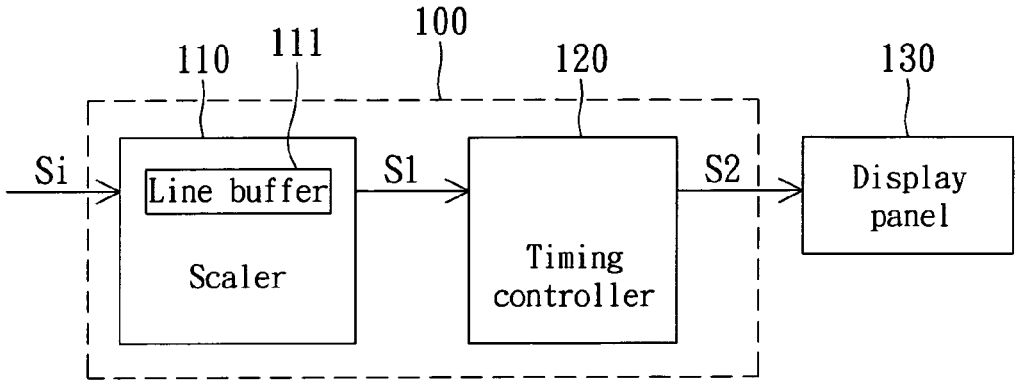
FIG. 1(PRIOR ART)
FIG. 1 is a block diagram of a conventional image processing system.
Figure 2:
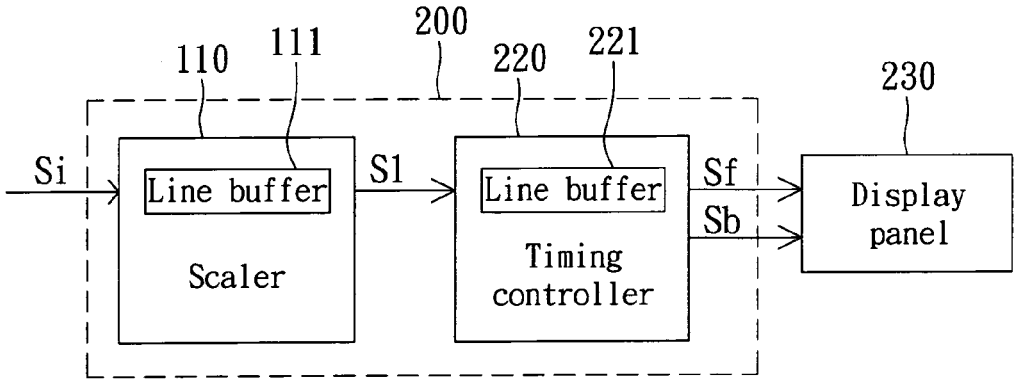
FIG. 2(PRIOR ART)
FIG. 2 is a block diagram of a conventional image processing system capable of processing high resolution image.
Figure 3A:
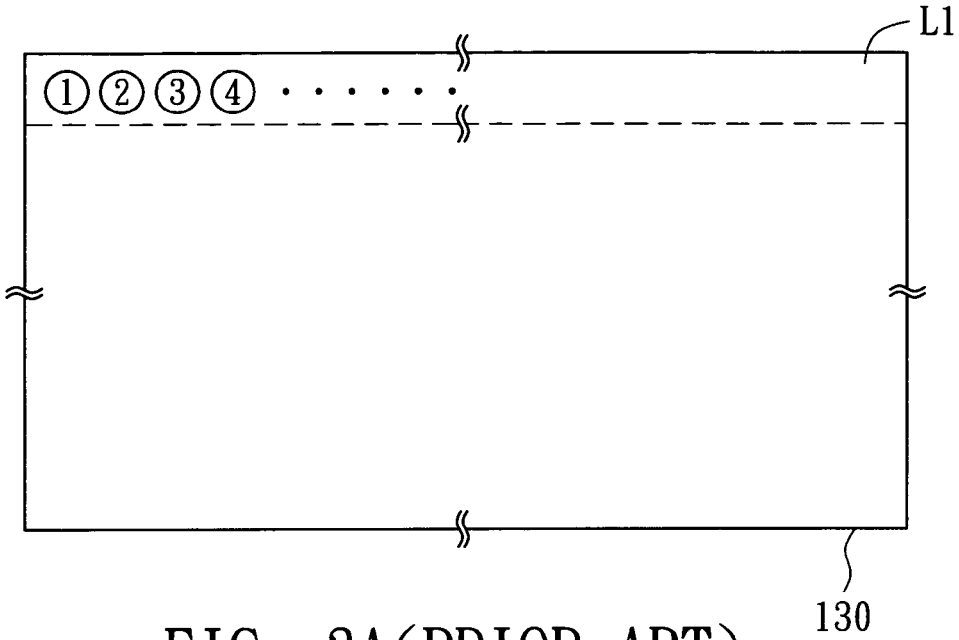
FIG. 3A(PRIOR ART)
FIG. 3A is a pixel diagram of a display panel.
Figure 3B:
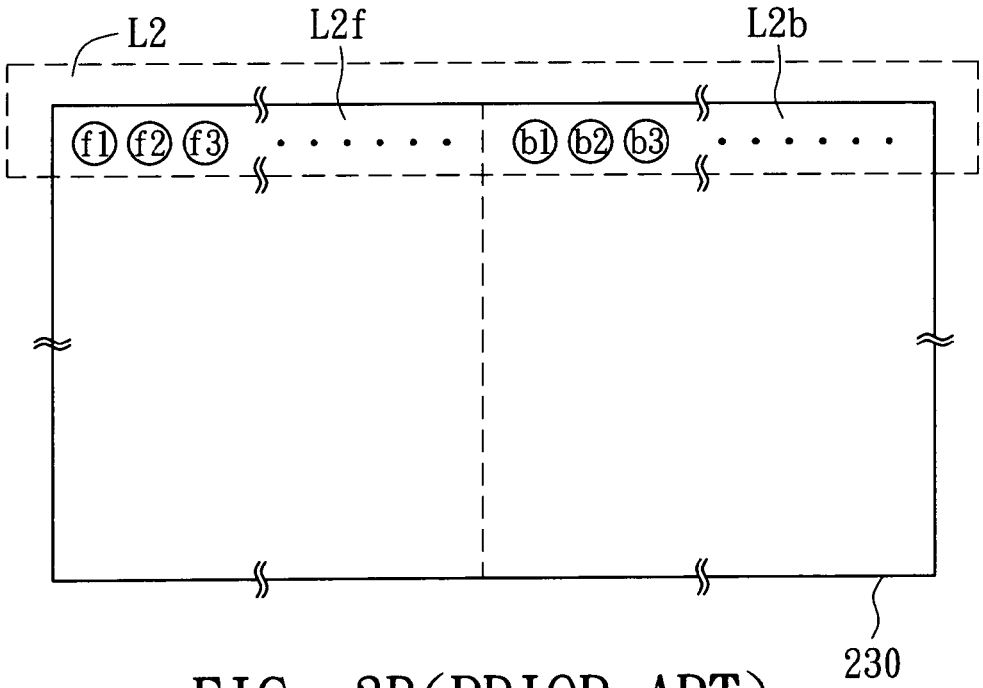
FIG. 3B(PRIOR ART)
FIG. 3B is a diagram of dividing the display panel into a front frame and a back frame.
Figure 5:
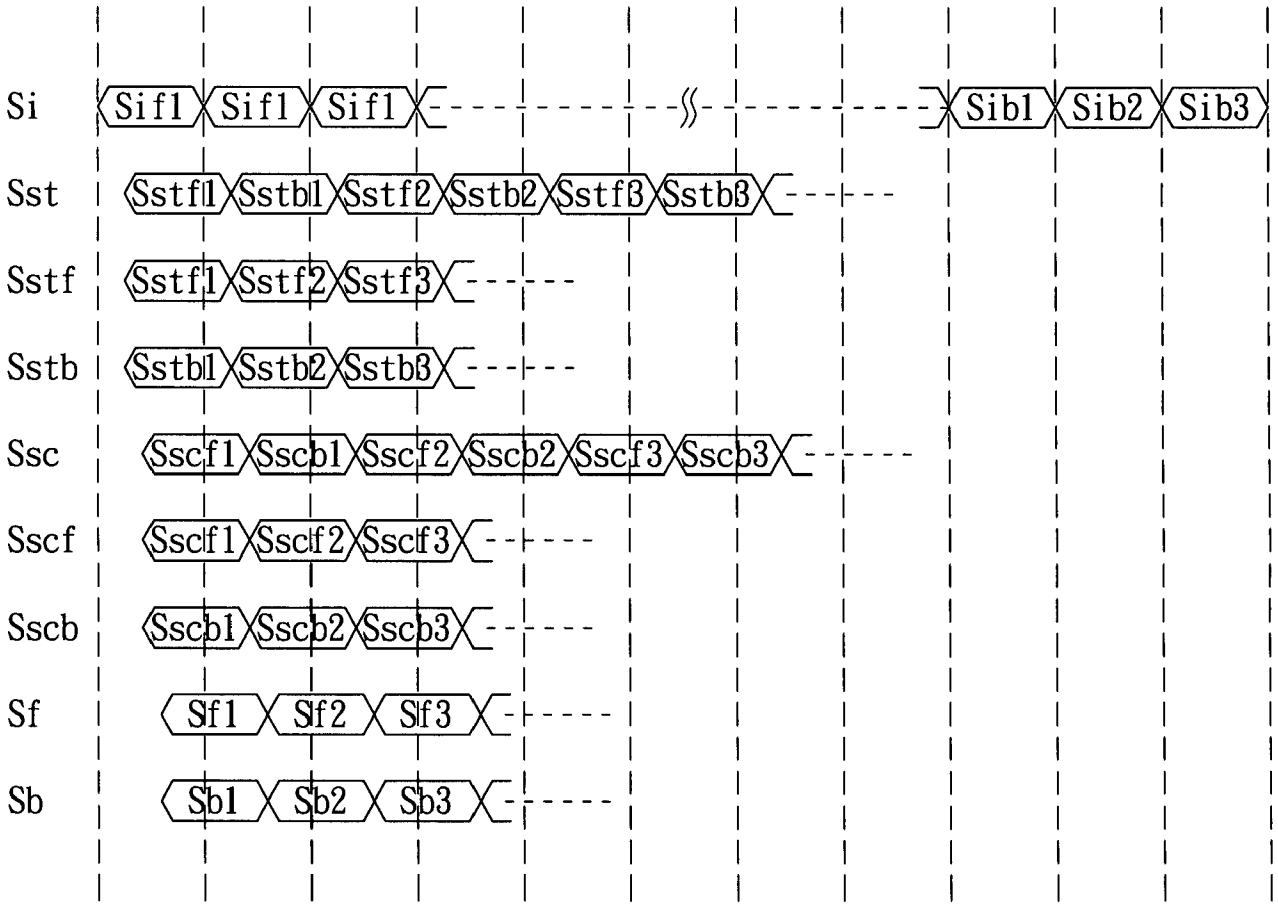
FIG. 5 is a signal timing diagram of an image processing module according to the first embodiment of the invention.

Referring to FIG. 5, a signal timing diagram of an image processing module according to a first embodiment of the invention is shown. Referring to both FIG. 3B and FIG. 5. The original image pixel signals of the original image signal Si are sequentially outputted according to the left-to-right sequence of the pixels. From the original image signal Si, the original image pixel signals Sif1, Sif2, and Sif3 corresponding to the pixels f1, f2, and f3 in the front-horizontal line L2*f* are outputted first. After the original image pixel signals corresponding to the front-horizontal line L2*f* have been outputted, the original image pixel signal Sib1, Sib2, and Sib3 corresponding to the pixel b1, b2, and b3 in the back-horizontal line L2*b* are outputted.

In the present embodiment, the timing controller 410 divides a horizontal line displayed on the display panel 230 divided into a front-horizontal line and a back-horizontal line. The storage image signal Sst is analyzed into a front-storage image signal Ssff corresponding to the front-horizontal line and a back-storage image signal Sstb corresponding to the back-horizontal line. From the front-storage image signal Sstf, the front-storage image pixel signals Sstf1, Sstf2, and Sstf3 are outputted in correspondence to the pixels f1, f2, and f3 of the front-horizontal line L2*f*. From the back-storage image signal Sstb, the back-storage image pixel signals Sstb1, Sstb2, and Sstb3 are outputted in correspondence to the pixels b1, b2, and b3 of the back-horizontal line L2*b*. The storage image signal Sst outputted by the line buffer 411 is outputted to the scaler 420 through a channel in the sequence of the front-storage image pixel signal Sstf1, the back-storage image pixel signal Sstb1, the front-storage image pixel signal Sstf2, and back-storage image pixel signal Sstb2. That is, the front-storage image signal Sstf alternates with the back-storage image signal Sstb to be outputted.

The scaler 420 correspondingly analyzes the scaled image signal Ssc into a front-scaled image signal Sscf and a back-scaled image signal Sscb respectively according to the front-storage image signal Sstf and the back-storage image signal Sstb. The front-scaled image signal Sscf outputs the front-scaled image pixel signals Sscf1, Sscf2, Sscf3 in correspondence to the pixels f1, f2, and f3 of the front-horizontal line L2*f*. The back-scaled image signal Sscb outputs the back-scaled image pixel signals Sscb1, Sscb2, Sscb3 in correspondence to the pixels b1, b2, and b3 of the back-horizontal line L2*b*. The scaled image signal Ssc outputted by the scaler 420 is outputted to the control unit 412 through a channel in the sequence of the front-scaled image pixel signal Sscf1, the back-scaled image pixel signal Sscb1, the front-scaled image pixel signal Sscf2, and the back-scaled image pixel signal Sscb2. That is, the front-scaled image signal Sscf alternates with the back-scaled image signal Sscb to be outputted.

The timing controller 410 outputs the front-display signals Sf and the back-display signal Sb according to the front-scaled image signal Sscf and the back-scaled image signal Sscb. From the front-display signal Sf, the front-display pixel signals Sf1, Sf2, and Sf3 are outputted in correspondence to the pixel f1, f2, and f3 of the front-horizontal line L2*f*. From the back-display signal Sb, the back-display pixel signals Sb1, Sb2, and Sb3 are outputted in correspondence to the pixels b1, b2, and b3 of the back-horizontal line L2*b*. The control unit 412 outputs the front-display signal Sf and the back-display signal Sb to drive the display panel 230 through a front-channel and a back-channel respectively.

Figure 6:
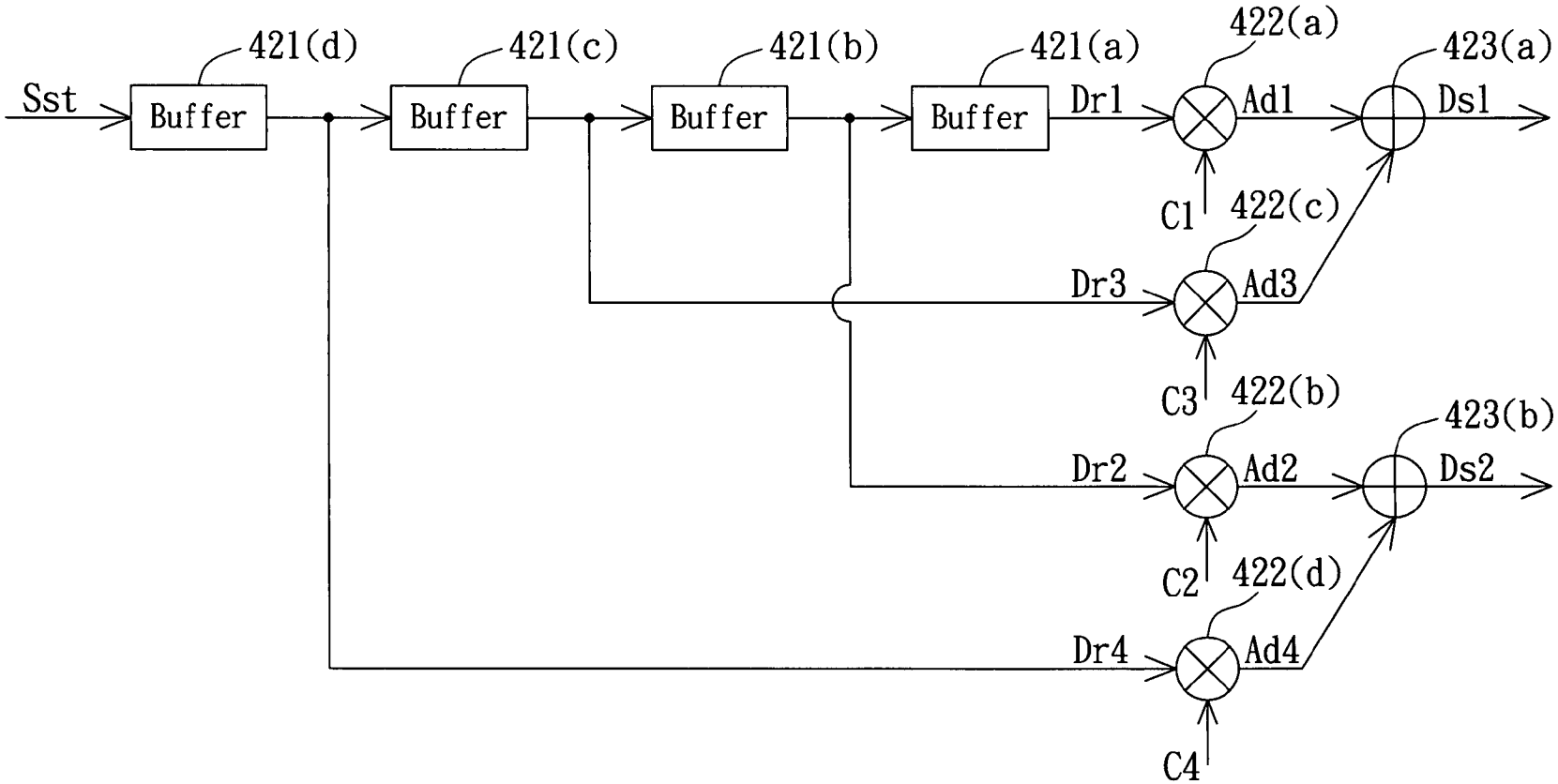
FIG. 6 is a diagram of a scaler according to the first embodiment of the invention.

Referring to FIG. 6, a diagram of a scaler according to the first embodiment of the invention is shown. When the storage image signal Sst is transmitted to the scaler 420 through a channel, the sequence of the stored data is different from that of the original image signal Si. The structure of the scaler 420 is elaborated below. The scaler 420 includes serially connected buffers 421(*a*) to 421(*d*), multipliers 422(*a*) to 422(*d*) and adders 423(*a*) and 423(*b*). The buffer 421(*a*) registers the front-storage image pixel signal Sstf1 corresponding to the pixel f1 of the front-horizontal line and then outputs buffer data Dr1. The buffer 421(*b*) registers the back-storage image pixel signal Sstb1 corresponding to the pixel b1 of the back-horizontal line and then outputs buffer data Dr2. The buffer 421(*c*) registers the front-storage image pixel signal Sstf2 corresponding to the pixel f2 of the front-horizontal line and then outputs buffer data Dr3. The buffer 421(*d*) registers the back-storage image pixel signal Sstb2 corresponding to the pixel b2 of the back-horizontal line and then outputs buffer data Dr4.

The multiplier 422(*a*) receives the buffer data Dr1 and a coefficient C1 to be multiplied together and then outputs adjusting data Ad1. The multiplier 422(*b*) receives the buffer data Dr2 and a coefficient C2 to be multiplied together and then outputs adjusting data Ad2. The multiplier 422(*c*) receives the buffer data Dr3 and a coefficient C3 to be multiplied together and then outputs adjusting data Ad3. The multiplier 422(*d*) receives the buffer data Dr4 and a coefficient C4 to be multiplied together and then outputs adjusting data Ad4. The adder 423(*a*) receives the adjusting data Ad1 and the adjusting data Ad3 to be added up and then outputs scaling data Ds1. The adder 423(*b*) receives the adjusting data Ad2 and the adjusting data Ad4 to be added up and then outputs scaling data Ds2. The scaler 420 adjusts the resolution of the storage image signal Ssc according to the scaling data Ds1 and scaling data Ds2 via an interpolation.

Embodiment Two

Figure 7:
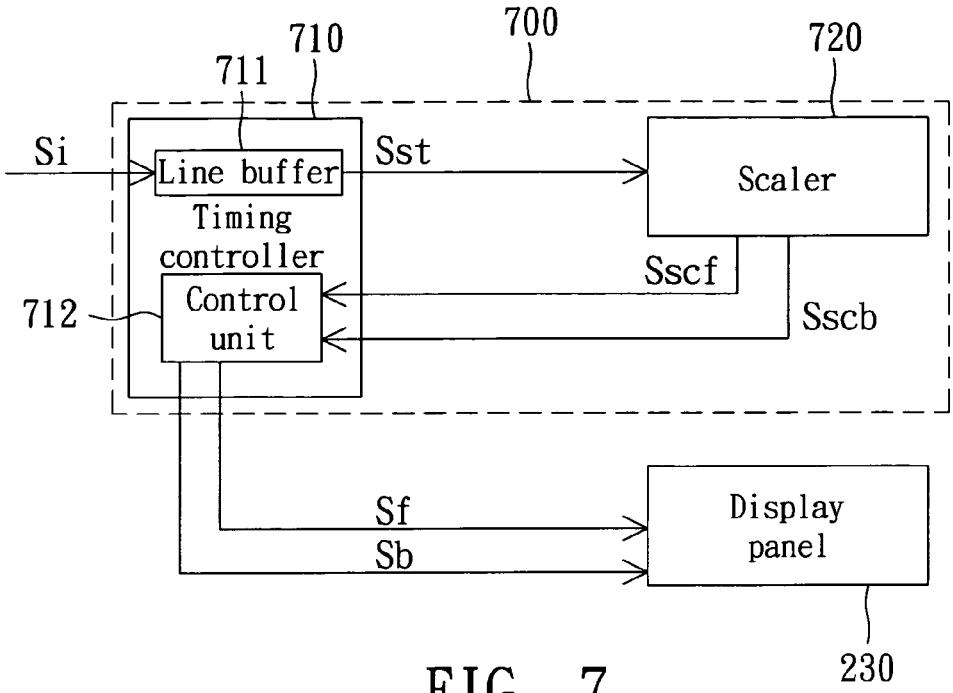
FIG. 7 is a block diagram of an image processing module according to a second embodiment of the invention.

Referring to FIG. 7, a block diagram of an image processing module according to a second embodiment of the invention is shown. Image processing module 700 includes a timing controller 710 and a scaler 720. The timing controller 710 includes a line buffer 711 and a control unit 712 to control the display panel 230. The present embodiment differs with the first embodiment in that the signal outputted by the scaler 720 differs with that outputted by the scaler 420. The scaler 710 simultaneously outputs the front-scaled image signal Sscf and the back-scaled image signal Sscb of the scaled image signal Ssc to the control unit 712 through a front-channel and a back-channel respectively. Other terms remain unchanged.

Embodiment Three

Figure 8:
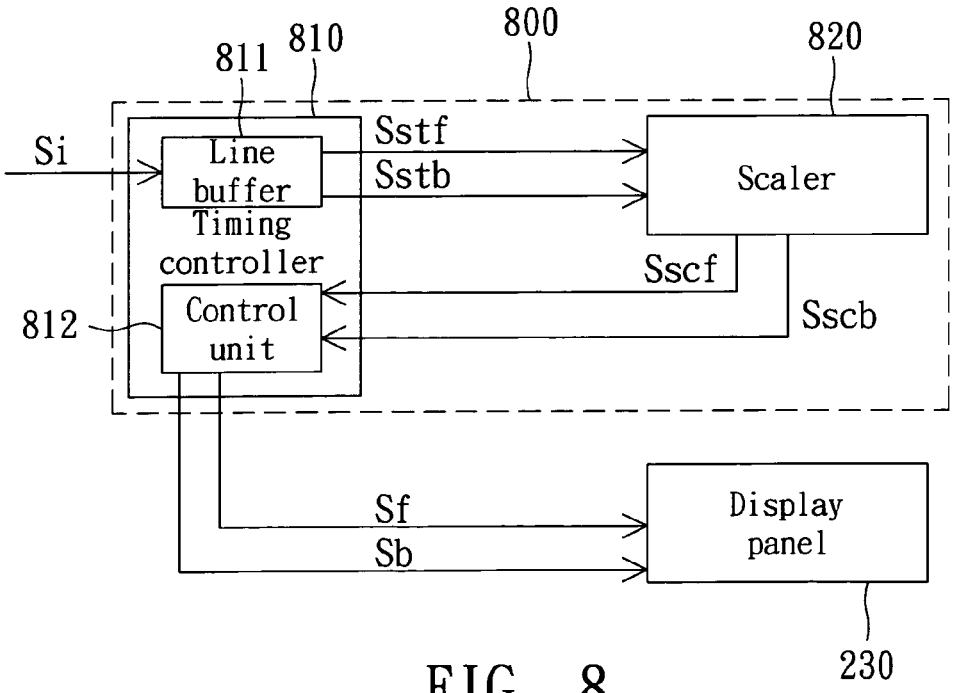
FIG. 8 is a block diagram of an image processing module according to a third embodiment of the invention.

Referring to FIG. 8, a block diagram of an image processing module according to a third embodiment of the invention is shown. Image processing module 800 includes a timing controller 810 and a scaler 820. The timing controller 810 includes a line buffer 811 and a control unit 812 to control the display panel 230. The present embodiment differs with the first embodiment in that the signals received and outputted by the scaler 820 are different from those received and outputted by the scaler 420. The scaler 820 receives the front-storage image signal Sstf and the back-storage image signal Sstb of the storage image signal Sst according to a front-channel and a back-channel respectively, and then outputs the front-scaled image signal Sscf and the back-scaled image signal Sscb of the scaled image signal Ssc to the control unit 812 according to a front-channel and a back-channel respectively.

Embodiment Four

Figure 9:
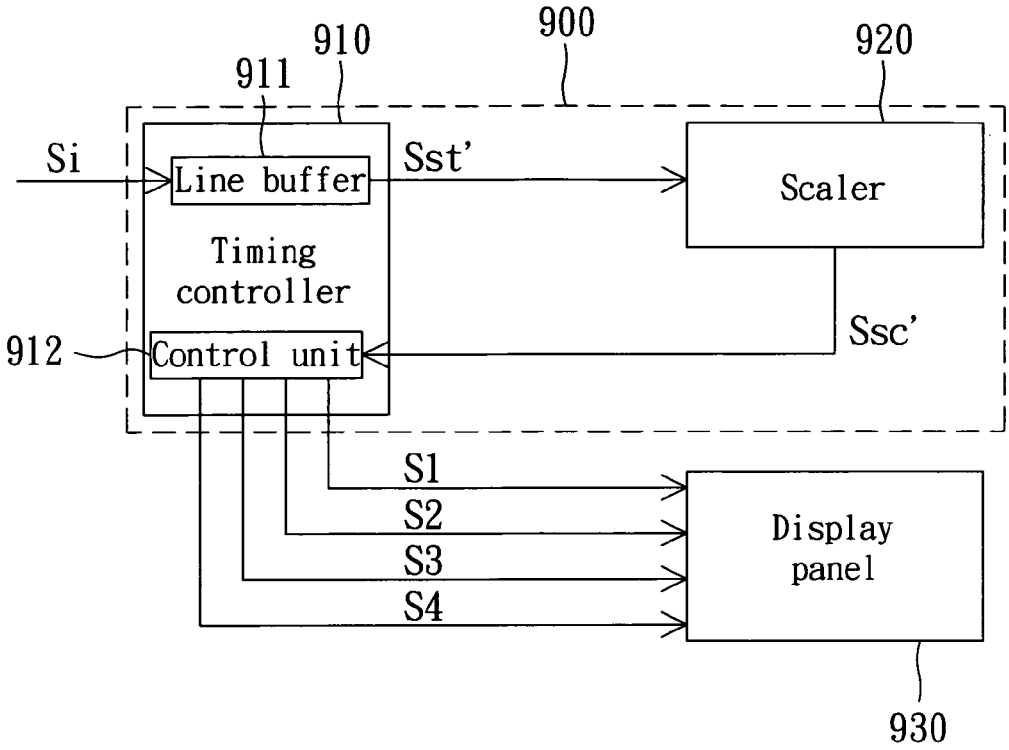
FIG. 9 is a block diagram of an image processing module according to a fourth embodiment of the invention.

Referring to FIG. 9, a block diagram of an image processing module according to a fourth embodiment of the invention is shown. Image processing module 900 is used for receiving an original image signal Si to drive the display panel 930. The image processing module 900 includes a timing controller 910 and a scaler 920. The timing controller 910 receives the original image signal Si, and then outputs a storage image signal Sst'. The scaler 920 receives a storage image signal Sst' and adjust the resolution of the storage image signal Sst', then outputs a scaled image signal Ssc'. Then, the timing controller 910 drives a display panel 930 according to the scaled image signal Ssc'. The timing controller 910 includes a line buffer 911 and a control unit 912. The line buffer 911 registers the original image signal Si, and then outputs the storage image signal Sst'. The control unit 912 receives the scaled image signal Ssc' and outputs a display signal S1, a display signal S2, a display signal S3 and a display signal S4 to drive the display panel 930 according to the scaled image signal Ssc'.

Figure 10:
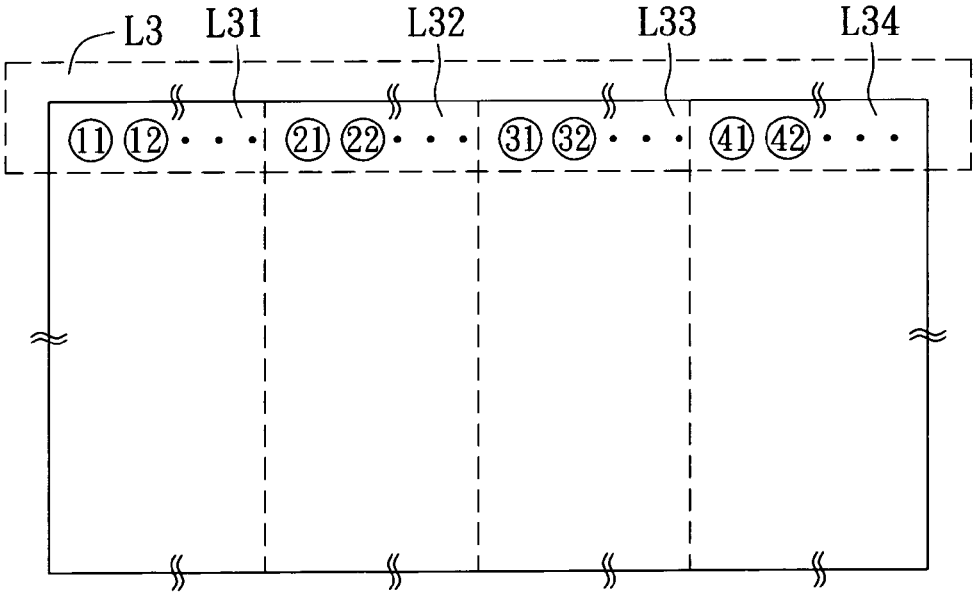
FIG. 10 is a diagram of dividing the display panel into four frames.

Referring to FIG. 10, a diagram of dividing the display panel 930 into four frames is shown. The present embodiment differs with the first embodiment in that the timing controller 910, divides a horizontal line L3 displayed by the display panel 930 into a horizontal line L31, a horizontal line L32, a horizontal line L33 and a horizontal line L34. The horizontal line L31 has a pixel 11 and a pixel 12. The horizontal line L32 has a pixel 21 and a pixel 22. The horizontal line L33 has a pixel 31 and a pixel 32. The horizontal line L34 has a pixel 41 and a pixel 42. The storage image signal Sst' correspondingly analyzes the horizontal line L31, the horizontal line L32, the horizontal line L33 and the horizontal line L34 as a first storage image signal Sst1, a second storage image signal Sst2, a third storage image signal Sst3 and a fourth storage image signal Sst4. Similarly, the scaled image signal Ssc' also correspondingly analyzes the horizontal line L31, the horizontal line L32, the horizontal line L33 and the horizontal line L34 as a first scaled image signal Ssc1, a second scaled image signal Ssc2, a third scaled image signal Ssc3 and a fourth scaled image signal Ssc4. The control unit 912 also outputs a first display signal S1, a second display signal S2, a third display signal S3 and a fourth display signal S4 in correspondence to the horizontal line L31, the horizontal line L32, the horizontal line L33 and the horizontal line L34.

Figure 11:
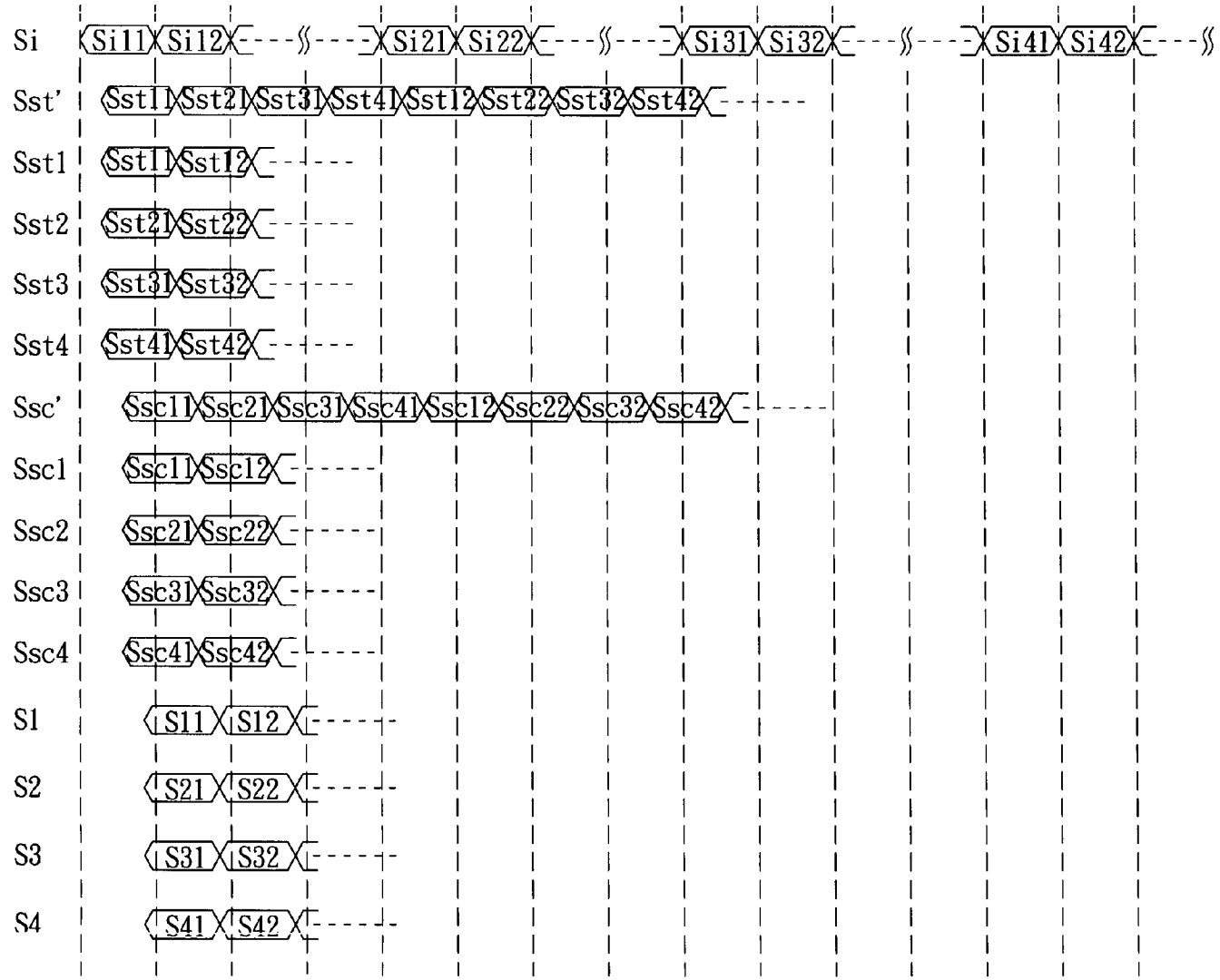
FIG. 11 is a signal timing diagram of an image processing module according to the fourth embodiment of the invention.

Referring to FIG. 11, a signal timing diagram of an image processing module according to the fourth embodiment of the invention is shown. The first storage image signal Sst1 has a first storage image pixel signal Sst11 and a first storage image pixel signal Sst12 in correspondence to the pixel 11 and the pixel 12. Similarly, the second storage image signal Sst2 has a second storage image pixel signal Sst21 and a second storage image pixel signal Sst22, the third storage image signal Sst3 has a third storage image pixel signal Sst31 and a third storage image pixel signal Sst32, and the fourth storage image signal Sst4 has a fourth storage image pixel signal Sst41 and a fourth storage image pixel signal Sst42 in correspondence to the pixel 21 and the pixel 22.

Similarly, the first scaled image signal Ssc1 has a first scaled image pixel signal Ssc11 and a second scaled image pixel signal Ssc12 in correspondence to the pixel 11 and the pixel 12. The second scaled image signal Ssc2 also has a second scaled image pixel signal Ssc21 and a second scaled image pixel signal Ssc22 in correspondence to the pixel 21 and the pixel 22. By the same token, the third scaled image signal Ssc3 has a third scaled image pixel signal Ssc31 and a second scaled image pixel signal Ssc32 and the fourth scaled image signal Ssc4 has a fourth scaled image pixel signal Ssc41 and a fourth scaled image pixel signal Ssc42 in correspondence to the pixel 11 and the pixel 12. The timing controller 910 correspondingly generates the first display signal S1 to the fourth display signal S4 according to the first scaled image signal Ssc1, the second scaled image signal Ssc2, the third scaled image signal Ssc3 and the fourth scaled image signal Ssc4. The first display signal S1 has a first display pixel signal S11 and a first display pixel signal S12. The second display signal S2 has a second display pixel signal S21 and a first display pixel signal S22. The third display signal S3 has a third display pixel signal S31 and a third display pixel signal S32. The fourth display signal S4 has a fourth display pixel signal S41 and a fourth display pixel signal S42.

The storage image signal Sst' outputted by the line buffer 911 is outputted to the scaler 920 through a channel in the sequence of the first storage image pixel signal Sst11, the second storage image pixel signal Sst21, the third storage image pixel signal Sst31, the fourth storage image pixel signal Sst41, and the first storage image pixel signal Sst12. That is, the first storage image signal Sst1, the second storage image signal Sst2, the third storage image signal Sst3 and the fourth storage image signal Sst4 are alternated with one another to be outputted.

Similarly, the scaled image signal Ssc' outputted by the scaler 920 is outputted to the control unit 912 through a channel in the sequence of the first scaled image pixel signal Ssc11, the second scaled image pixel signal Ssc21, the third scaled image pixel signal Ssc31, the fourth scaled image pixel signal Ssc41, and the first scaled image pixel signal Ssc12. That is, the first scaled image signal Ssc1, the second scaled image signal Ssc2, the third scaled image signal Ssc3 and the fourth scaled image signal Ssc4 are alternated with one another to be outputted. The control unit 912 simultaneously outputs the first display signal S1, the second display signal S2, the third display signal S3 and the fourth display signal S4 to drive the display panel 930 through a first channel, a second channel, a third channel and a fourth channel respectively.

Figure 12:
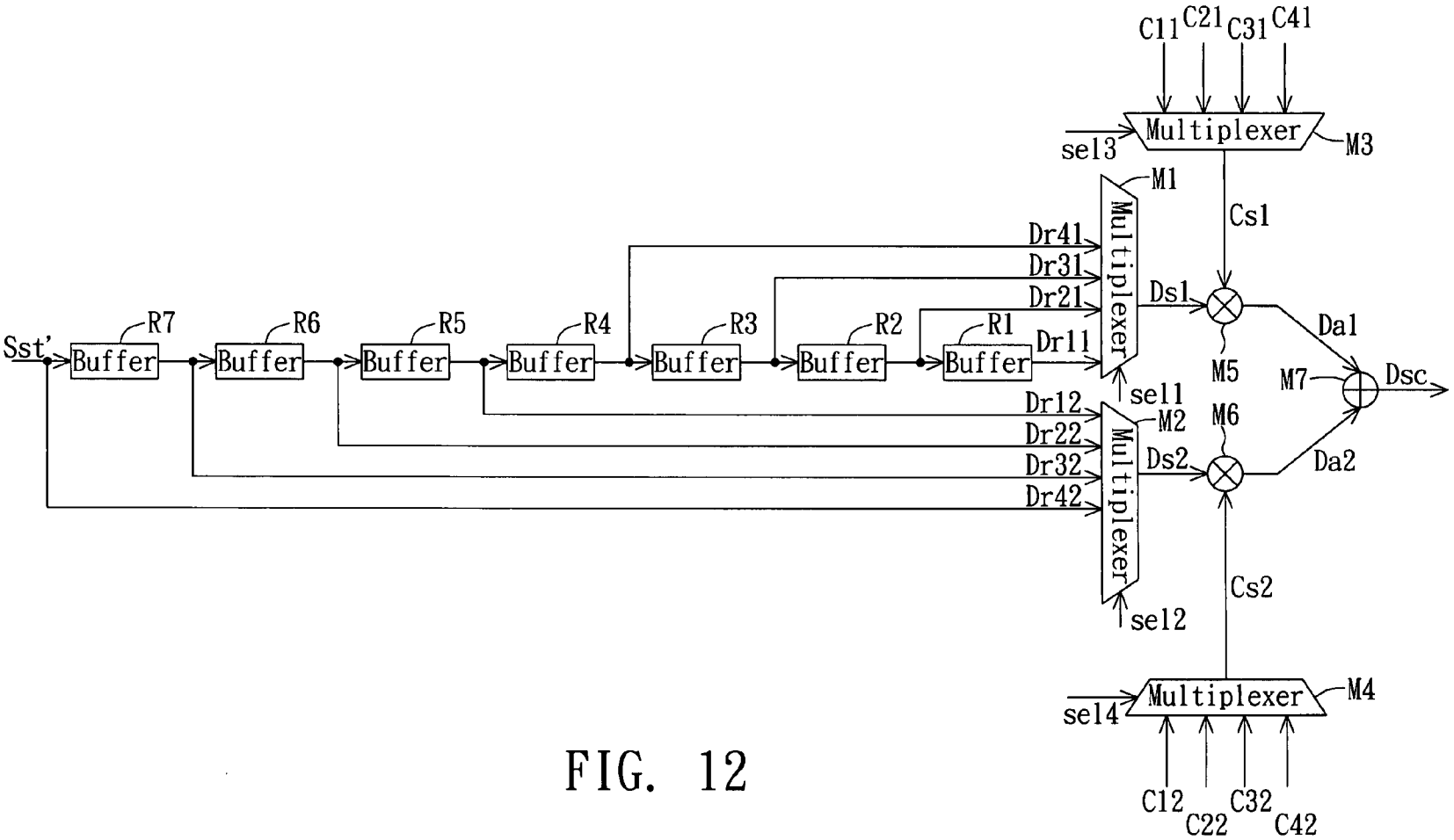
FIG. 12 is a diagram of a scaler according to the fourth embodiment of the invention.

Referring to FIG. 12, a diagram of a scaler according to the fourth embodiment of the invention is shown. When the storage image signal Sst' is transmitted to the scaler 920 through a channel, the sequence of the stored data is different with that of the original image signal Si. The structure of the scaler 920 is elaborated below. The scaler 920 includes serially connected buffers R1 to R7, multi-processors M1 to M4, multipliers M5 and M6, and an adder M7. The buffer R1 outputs buffer data Dr11 in correspondence to the first storage image pixel signal Sst11 of the pixel 11. The buffer R2 outputs buffer data Dr21 in correspondence to the second storage image pixel signal Sst21 of the pixel 21. The buffer R3 outputs a buffer data Dr31 in correspondence to the third storage image pixel signal Sst31 of the pixel 31. The buffer R4 outputs buffer data Dr41 in correspondence to the fourth storage image pixel signal Sst41 of the pixel 41. The buffer R5 outputs buffer data Dr12 in correspondence to the first storage image pixel signal Sst12 of the pixel 12. The buffer R6 outputs buffer data Dr22 in correspondence to the second storage image pixel signal Sst22 of the pixel 22. The buffer R7 outputs buffer data Dr32 in correspondence to the third storage image pixel signal Sst32 of the pixel 32.

The multi-processor M1 receives the buffer data Dr11, Dr21, Dr31 and Dr41 and outputs select data Ds1 according to the selecting signal sel1. The multi-processor M2 receives the buffer data Dr12, Dr22, Dr32 and Dr42 generated according to the fourth storage image pixel signal Sst42, and outputs select data Ds2 according to the selecting signal sel2. The multi-processor M3 receives the coefficient C11, C21, C31 and C41, and outputs one of the coefficients C11~C41 to be a select coefficient Cs1 according to the selecting signal sel3. The multi-processor M4 receives the coefficient C12, C22, C32 and C42, and outputs one of the coefficient C12~C42 to be a select coefficient Cs2 according to the selecting signal sel4. The multiplier M5 receives the select data Ds1 and the select coefficient Cs1 to be multiplied together and then outputs adjusting data Da1. The multiplier M6 receives the select data Ds2 and the select coefficient Cs2 to be multiplied together and then outputs adjusting data Da2. The adder M7 receives the adjusting data Da1 and the adjusting data Da2 to be added up and then outputs scaling data Dsc. The scaler 920 adjusts the resolution of the storage image signal Sst' according to the scaling data Dsc via interpolation.

Embodiment Five

Figure 13:
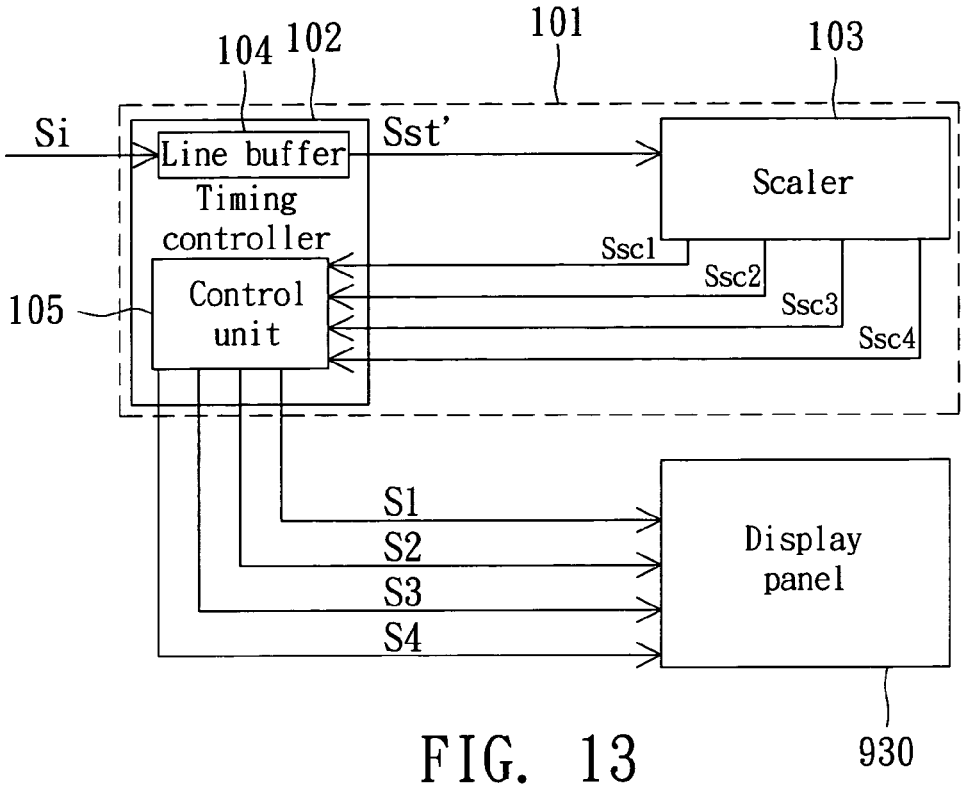
FIG. 13 is a block diagram of an image processing module according to a fifth embodiment of the invention.

Referring to FIG. 13, a block diagram of an image processing module according to a fifth embodiment of the invention is shown. Image processing module 101 includes a timing controller 102 and a scaler 103. The timing controller 102 includes a line buffer 104 and a control unit 105. The present embodiment differs with the fourth embodiment in that scaler 103 simultaneously outputs the first scaled image signal Ssc1, second scaled image signal Ssc2, third scaled image signal Ssc3 and fourth, scaled image signal Ssc4 to the control unit 105 through the four channel respectively.

Embodiment Six

Figure 14:
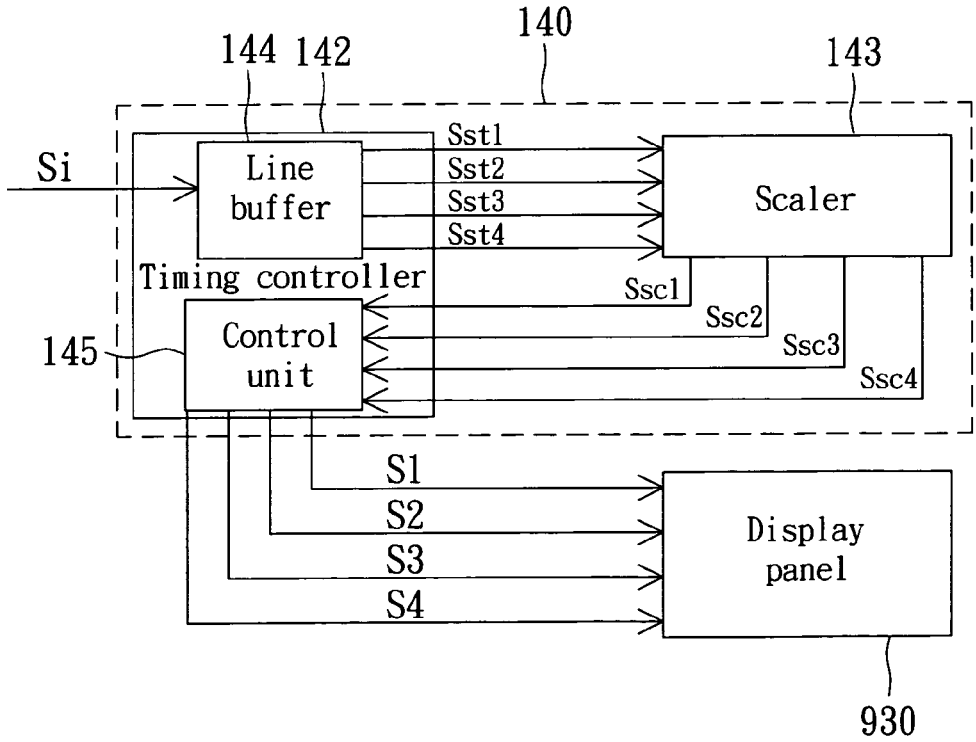
FIG. 14 is a block diagram of an image processing module according to a sixth embodiment of the invention.

Referring to FIG. 14, a block diagram of an image processing module according to a sixth embodiment of the invention is shown. Image processing module 140 includes a timing controller 142 and a scaler 143. The timing controller 142 includes a line buffer 144 and a control unit 145. The present embodiment differs with the fifth embodiment in that the line buffer 144, simultaneously outputs the first storage image signal Sst1, second storage image signal Sst2, third storage image signal Sst3 and fourth storage image signal Sst4 to the scaler 143 through the four channels respectively.

Embodiment Seven

Figure 15:
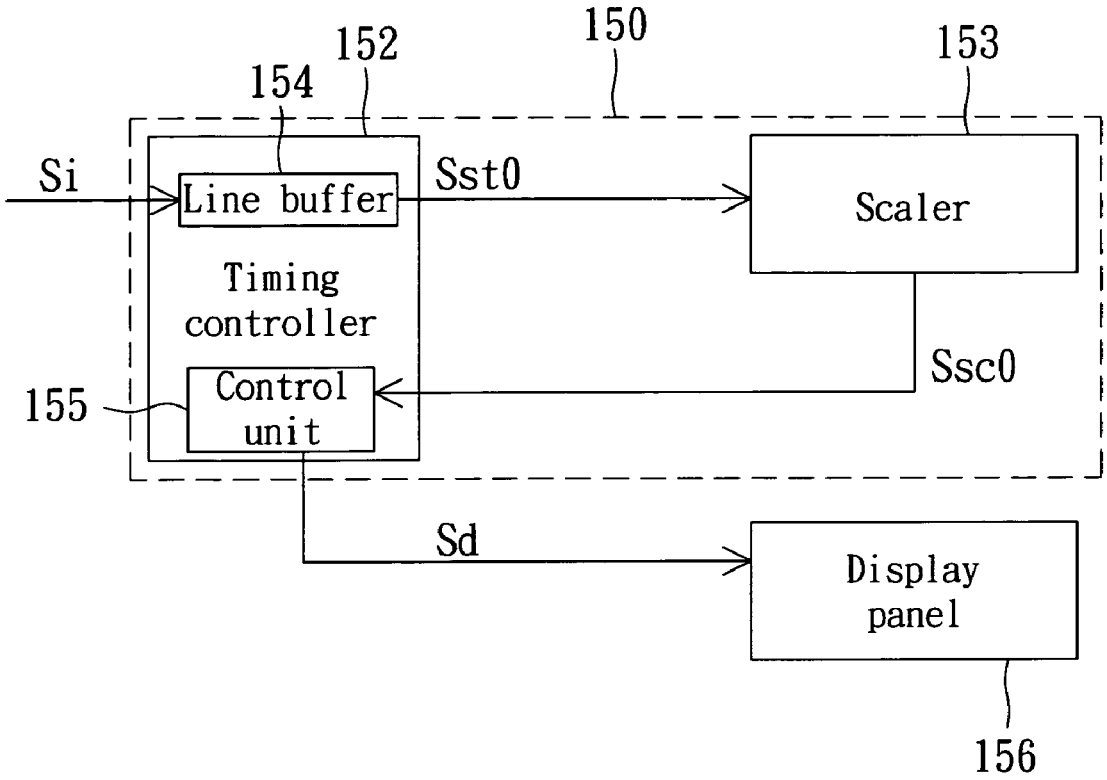
FIG. 15 is a block diagram of an image processing module according to a seventh embodiment of the invention.

Referring to FIG. 15, a block diagram of an image processing module according to a seventh embodiment of the invention is shown. Image processing module 150 includes a timing controller 152 and a scaler 153. The timing controller 152 includes a line buffer 154 and a control unit 155. The present embodiment differs with the first embodiment in that the timing controller 152 does not divide the horizontal line of the display panel 150 into two or four horizontal lines, and that both the storage image signal Sst0 and the scaled image signal Ssc0 correspond to the sequence of the pixel according to the sequence of the data in the original image signal Si without making any change.

Compared with the conventional image processing system, the image processing module disclosed in the above embodiment of the invention provides a simplified structure allowing the timing controller to share the line buffer with the scaler. That is, the image processing module of the invention can meet the high resolution requirement without resorting to the repeats in the installation of line buffer. The line buffer of the timing controller is used to perform a registering procedure in a resolution adjusting process in replace of the line buffer of the scaler.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An image processing module used for receiving an original image signal to drive a display panel, the image processing module comprising:

a timing controller, comprising:

a line buffer, for registering the original image signal and outputting a storage image signal; and a control unit; and a scaler, for receiving the storage image signal, adjusting the resolution of the storage image signal, and outputting a scaled image signal to the control unit according to the resolution of the storage image signal;

wherein the control unit receives the scaled image signal, registers the scaled image signal in the line buffer, changes a timing of the scaled image signal, and simultaneously outputs a front-display signal and a back-display signal to drive the display panel according to the scaled image signal;

wherein the timing controller divides a horizontal line displayed on the display panel into a front-horizontal line and a back-horizontal line, so that the storage image signal is analyzed into a front-storage image signal corresponding to the front-horizontal line and a back-storage image signal corresponding to the back-horizontal line;

wherein the front-storage image signal comprises a plurality of front-storage image pixel signals, the back-storage image signal comprises a plurality of back-storage image pixel signals, and the timing controller outputs the storage image signal to the scaler through a channel with the front-storage image pixel signals alternating with the back-storage image pixel signals;

wherein the scaler further comprises:

a first buffer, a second buffer, a third buffer and a fourth buffer sequentially connected in serial, wherein the first buffer registers the data of the front-storage image signal corresponding to a first pixel in the front-horizontal line and outputs first registered data, wherein the second buffer registers the data of the back-storage image signal corresponding to a second pixel in the back-horizontal line and outputs second registered data, wherein the third buffer registers the data of the front-storage image signal corresponding to a third pixel in the front-horizontal line and outputs third registered data, wherein the fourth buffer registers the data of the back-storage image signal corresponding to a fourth pixel in the back-horizontal line and outputs fourth registered data;

a first multiplier, for multiplying the first registered data by a first coefficient and then outputting first adjusting data;

a second multiplier, for multiplying the second registered data with a second coefficient and then outputting second adjusting data;

a third multiplier, for multiplying the third registered data by a third coefficient and then outputting third adjusting data;

a fourth multiplier, for multiplying the fourth registered data with a fourth coefficient and then outputting fourth adjusting data;

a first adder, for receiving the first adjusting data and the third adiusting data to be added UP and then outputting first scaling data; and a second adder, for receiving the second adjusting data and the fourth adiusting data to be added up and then outputting second scaling data;

wherein, the scaler adjusts the resolution of the storage image signal according to the first scaling data and the second scaling data.

2. The module according to claim 1, wherein the timing controller simultaneously outputs the front-storage image signal and the back-storage image signal of the storage image signal to the scaler through a front-channel and a back-channel respectively.

3. The module according to claim 1, wherein the scaler correspondingly analyzes the scaled image signal as a front-scaled image signal and a back-scaled image signal according to the front-storage image signal and the back-storage image signal

4. The module according to claim 3, wherein the scaler outputs the front-scaled image signal and the back-scaled image signal of the scaled image signal to the control unit respectively through a front-channel and a back-channel.

5. The module according to claim 3, wherein the front-scaled image signal comprises a plurality of front-scaled image pixel signal, the back-scaled image signal comprises a plurality of back-scaled image pixel signal, the scaler outputs the scaled image signal to the control unit through a channel with the front-scaled image pixel signal alternating with the back-scaled image pixel signal.

6. The module according to claim 3, wherein the control unit correspondingly outputs the front-display signal and the back-display signal according to the front-scaled image signal and the back-scaled image signal.

7. The module according to claim 6, wherein the control unit outputs the front-display signal and the back-display signal of the displaysignal to drive panel through a front-channel and a back-channel respectively.

8. The module according to claim 1, wherein the timing controller divides a horizontal line displayed on the display panel into a first horizontal line, a second horizontal line, a third horizontal line and a fourth horizontal line, so that the storage image signal is correspondingly analyzed into a first storage image signal, a second storage image signal, a third storage image signal and a fourth storage image signal respectively corresponding to the first horizontal line, the second horizontal line, the third horizontal line and the fourth horizontal line.

9. The module according to claim 8, wherein the timing controller simultaneously outputs the first storage image signal, the second storage image signal, the third storage image signal and the fourth storage image signal of the storage image signal to the scaler through a first channel, a second channel, a third channel and a fourth channel respectively.

10. The module according to claim 9, wherein the first storage image signal comprises a plurality of first storage image pixel signal, the second storage image signal comprises a plurality of second storage image pixel signal, the third storage image signal comprises a plurality of third storage image pixel signal, the fourth storage image signal comprises a plurality of fourth storage image pixel signal, and the timing controller outputs the storage image signal to the scaler through a channel with the first storage image pixel signals, the second storage image pixel signals, the third storage image pixel signals and the fourth storage image pixel signals alternating one another.

11. The module according to claim 8, wherein the scaler correspondingly analyzes the scaled image signal as a first scaled image signal, a second scaled image signal, a third scaled image signal and a fourth scaled image signal according to the first storage image signal, the second storage image signal, the third storage image signal and the fourth storage image signal

12. The module according to claim 11, wherein the scaler outputs the first scaled image signal, the second scaled image signal, the third scaled image signal and the fourth scaled image signal of the scaled image signal to the control unit through a first channel, a second channel, a third channel and a fourth channel respectively.

13. The module according to claim 12, wherein the first scaled image signal comprises a plurality of first scaled image pixel signal, the second scaled image signal comprises a plurality of second scaled image pixel signal, the third scaled image signal comprises a plurality of third scaled image pixel signal, the fourth scaled image signal comprises a plurality of fourth scaled image pixel signal, the scaler outputs the scaled image signal to the control unit through a channel with the first scaled image pixel signals, the second scaled image pixel signals, the third scaled image pixel signals and the fourth scaled image pixel signals alternating one another.

14. The module according to claim 11, wherein the timing controller correspondingly analyzes the display signal as a first display signal, a second display signal, a third display signal and a fourth display signal according to the first scaled image signal, the second scaled image signal, the third scaled image signal and the fourth scaled image signal.

15. The module according to claim 14, wherein the control unit outputs a first display signal, a second display signal, a third display signal and a fourth display signal of the display signal to drive the display panel through a first channel, a second channel, a third channel and a fourth channel respectively.

* * * * *